US005146434A

United States Patent [19]

Bromley

[11] Patent Number: 5,146,434

[45] Date of Patent: Sep. 8, 1992

[54] SOUND FOCUSING DEVICE

[76] Inventor: Daniel Bromley, 18242 Highland Ave., Homewood, Ill. 60430

[21] Appl. No.: 688,982

[22] Filed: Apr. 22, 1991

[51] Int. Cl.[5] ..... G10K 11/00

[52] U.S. Cl. ..... 367/140; 181/186; 181/143; 181/175; 116/137 R; 116/147

[58] Field of Search ..... 181/185, 186, 75, 42, 181/143; 116/137 R, 140, 147; 367/140

[56] References Cited

U.S. PATENT DOCUMENTS 1,506,393 8/1924 Thomas ..... 181/186
1,941,324 12/1933 Schirmer ..... 116/140
4,138,673 2/1979 Faust ..... 116/147
4,847,590 7/1989 Gosswiller ..... 116/147

*Primary Examiner*—J. W. Eldred
*Attorney, Agent, or Firm*—Patula & Associates

[57] ABSTRACT

A sound focusing device for use with a siren. The device is comprised of an adjustable baffle or damper reducing the velocity of air or sound eminating from a siren. The baffle or damper is positioned internal to the siren. A conical sound focusing trumpet is positioned co-axially and external to the siren. The baffle or damper is made up of two complementary disks forming at least one defined opening therein. The baffle or damper is selectively adjustable.

18 Claims, 3 Drawing Sheets

SOUND FOCUSING DEVICE

This invention relates to a device for focusing and reducing sound from unwanted areas. The invention is specifically useful for reducing to acceptable levels, the interior or cab sound volume levels in an emergency vehicle from its exterior siren or other warning device.

BACKGROUND OF THE INVENTION

Before the present invention, sirens, bells, whistles and other noise emitting devices mounted on emergency vehicles produced high levels of sound to warn others as the emergency vehicle proceeded to an emergency scene. Unfortunately, the occupants of the vehicle, were exposed to potentially dangerous and injurious levels of sound. No known device other than the present invention is intended on focusing and reducing the warning sound in an interior cab of an emergency vehicle to acceptable levels and still adequately warn other non-emergency vehicles of the emergency vehicle's approach.

Most known devices, such as that described in U.S. Pat. No. 4,138,673 to Faust, are intended on improving the performance of a siren by producing a more piercing and effective sound. The present invention attempts to focus the sound to be effective in regard to the special area around the siren, particularly the vehicle it is positioned on.

Devices such as that described in U.S. Pat. No. 1,941,324 to Schirmer are only able to adjust or lessen the emitted sound but do nothing to focus the emitted sound in a simple manner, with few components and needing only minor calibration. The invention to Schirmer is particularly suited for building fire alarms allowing one signal device to be used in an number of applications. The vibrating horn uses a diaphragm which moves in a back and forth motion pushing and pulling on the air around it to produce sound. This rapid back and forth movement of sound producing air, can then be contained within the confines of the device by use of the baffle or damper. The sound is actually being generated by the sound generating device based on the air contained within the device. Regardless of the damper's position, the air contained within allows for this sound generation. The damper's only perceived function is to keep the movement of this air within the structure of the horn thus diminishing sound external to the sound device. The invention disclosed in Schirmer is different in both theory and application from the present invention.

The present invention affords the use of a single internal damper or baffle to reduce the emitted sound level and focus the sound away from the cab interior of an emergency vehicle. The damper limits the sound producing media, that being air from reaching the sound generating device thus limiting the device's sound producing potential. This is due to the vacuum-type effect at the point the damper placed. Schirmer's sound generating mechanism produces alternating positive and negative air pulses with its back and forth movement of the diaphragm thus not requiring a constant supply of fresh air to continue generating sound. Again, the present invention damper works in a vacuum type of environment when the sound device is in use and acts to limit air volume to a device that requires a constant "flow through" of air to produce sound.

Simply stated, Schirmer's dampers are used to contain an already generated sound from escaping the confines of the device, whereas the damper in the present invention is used to prevent the sound from being produced in the first place. The damper in the present invention does not contain the sound, but limits its production. Schirmer uses a no-air-out, no-sound-out theory. The present invention uses no-air-in, no-sound produced theory.

It should be noted that the sound generating devices for which the present invention was conceived, are all totally air "flow through" dependant devices. Unlike those shown in Schirmer, where the horn is not air "flow through" dependant as it reuses the same given volume of air it contains within.

The present invention has application not only to new sirens but also as a retrofit device on existing sirens. This is especially important in that numerous other sirens and general warning devices require that a new siren be purchased in order to reduce the sound emitted to meet government sound reduction standards.

BRIEF SUMMARY OF THE INVENTION

The present invention adjusts the overall volume and receiving direction of the sound emitted from an electro-mechanical sound emitting device. By the use of a damper positioned internal to the sound emitting device and a conically trumpet focusing device conically coaxially outside the sound emitting device housing, the effective sound level to the rear or non-sound emitting end of the sound emitting end unit is reduced for vehicle operator and passenger safety while at the same time increasing the sound levels in the front of the siren unit where the sound delivered to warn others is desired. The present invention increases the air flow velocity or sound at the mouth of trumpet focusing device while decreasing air flow velocity or sound at the sound emitting source by the positioning of the damper.

It is further intended that the present invention be a retro-fit device to be positioned on the many thousands of sound emitting devices or sirens already in use on emergency vehicles. Because of the early vintage of such sirens, it is highly useful and cost effective to implement the present invention in order to avoid the cost inefficiency of having to scrap the existing sound emitting devices or sirens just in order to reach new sound emission standards promulgated by governmental authorities.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DESCRIPTION OF THE PREFERRED EMBODIMENT

Figure 1:
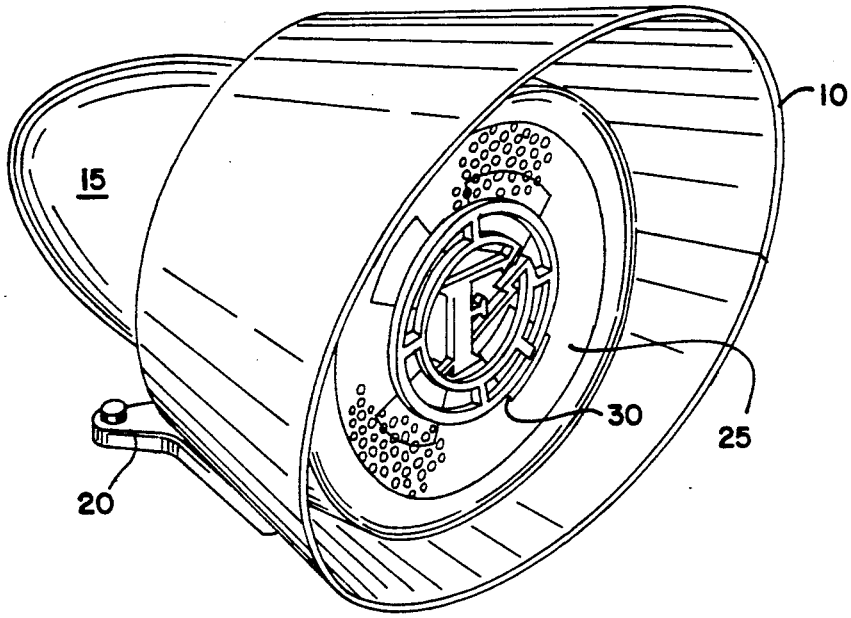
FIG. 1 is a perspective view of a siren with sound focusing trumpet positioned thereon.

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

The invention performs in the following manner. The device adjusts the overall volume and direction of the sound produced and emitted from an electro-mechanical siren. Its desired purpose is to focus an otherwise omni-directional emission of sound into a more unidirectional sound pattern. One of the safety objectives of the present invention is to reduce the sound levels to the rear of the siren for the emergency vehicle operator's safety and to increase the sound levels in front of the siren unit where the emitted sound is most desired.

Referring now to the drawing figures, and more particularly to FIG. 1, shown in perspective is the conical sound focusing trumpet 10 shown positioned coaxially over a sound emitting device or siren 15, which is mounted by conventional mounting hardware 20, on but not limited to, an emergency vehicle (not shown). The siren 15 may be of the type Model Nos. Q2A and Q2B offered by the Federal Signal Corporation of Oak Brook, Illinois. However, the present invention is intended to work with any type siren or warning type device needing the advantages and corrective action described herein. The siren 15 will preferably have a front face plate 25 and adjusting arm 30 as depicted extending out therefrom.

Figure 2:
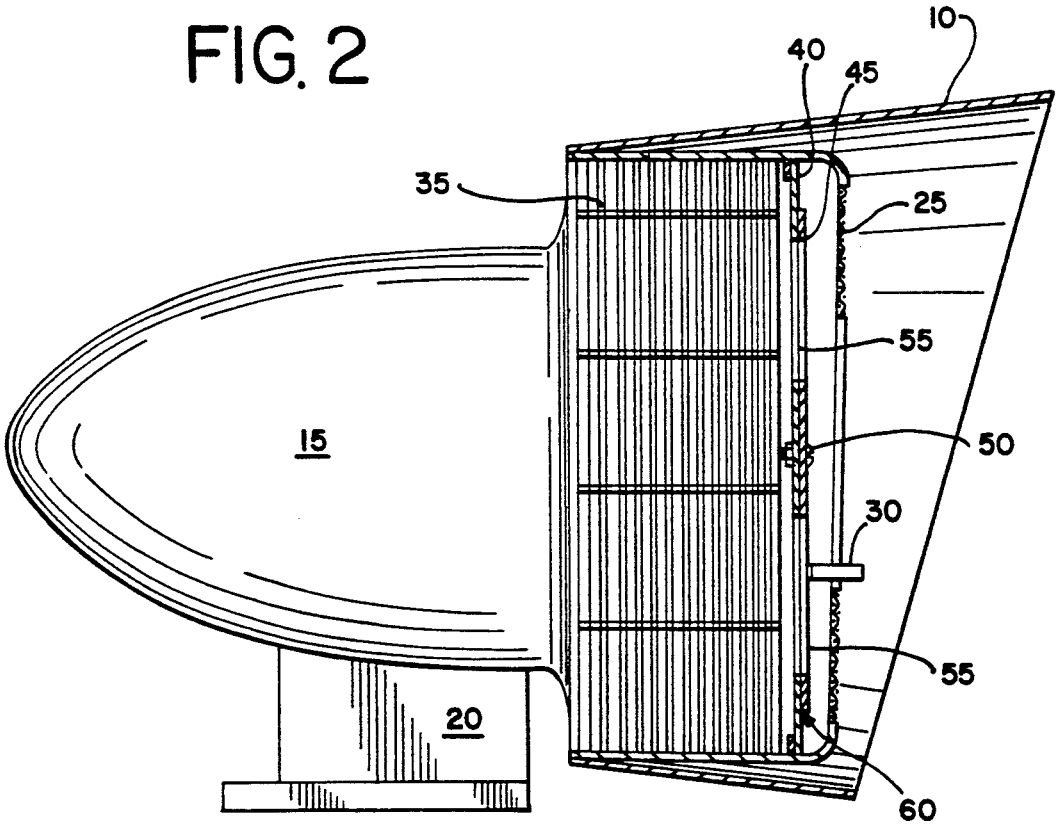
FIG. 2 is a cut-away side view of a siren with the present invention positioned thereon.

FIG. 2 is a side partial cross-sectional view of the siren 15, mounting hardware 20, siren side grill 35, two complementary disks 40 and 45 pivot axis screw 50 to form a damper or baffle 60. Openings of 55 of adjustable sizes are selectively obtained by moving adjusting arm 30. A front face place 25 is depicted as baffle or damper 60. A conical sound focusing trumpet 10 is positioned coaxially over siren 15 starting from siren's side grill 35 and extending to and past face plate 25.

Figure 3:
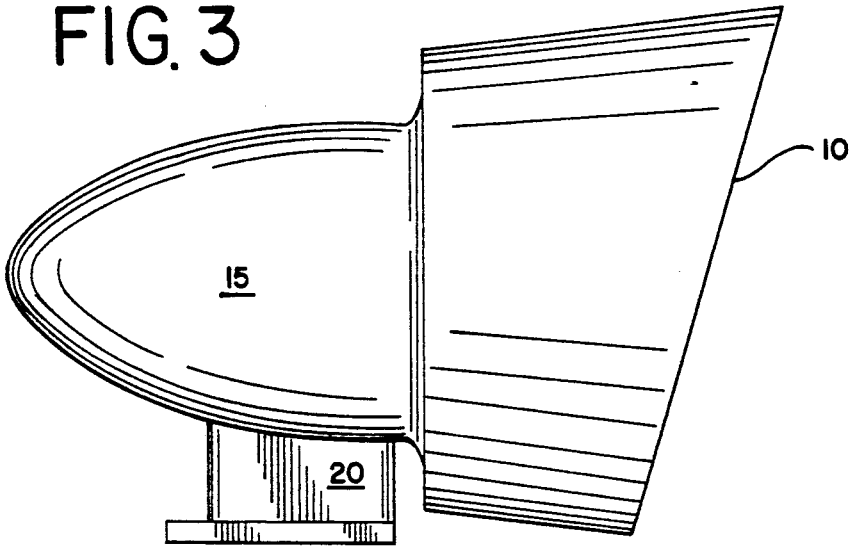
FIG. 3 is a side view of the present invention on a siren.

FIG. 3 is a side plan view of the siren 15, mounting hardware 20 with trumpet 10 positioned over side grill 35 (not shown). The sound of air emitted, from the siren 15 through side grill 35 is increased in velocity in the direction of and toward the trumpet opening.

Figure 4:
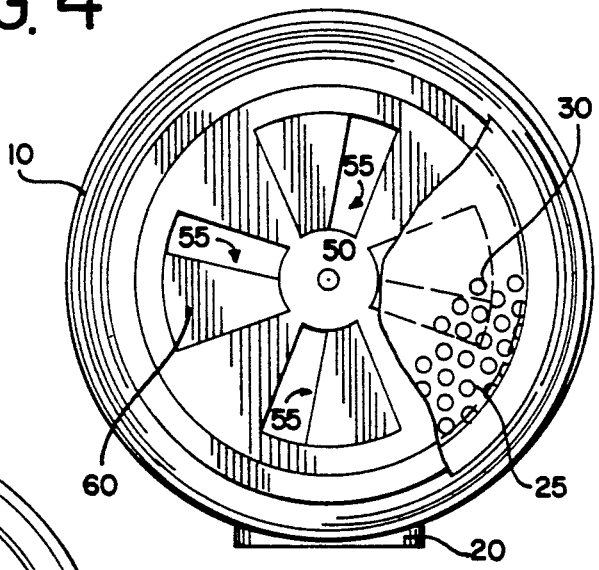
FIG. 4 is an axial partial cut-away front view of the present invention integrated with a siren.

FIG. 4 is a partial cutaway front plan view of the siren 15, mounting hardware 20, trumpet 10 over front face plate 25, damper 60 and openings 55 shown partially opened by moving adjusting arm 30.

Figure 5:
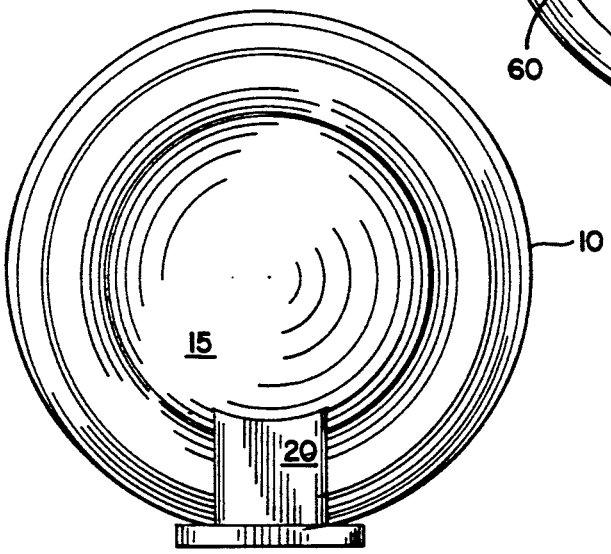
FIG. 5 is an axial back view of the present invention upon a siren.

FIG. 5 is a back plan view of the siren 15, mounting hardware 20 and trumpet 10.

Figure 6:
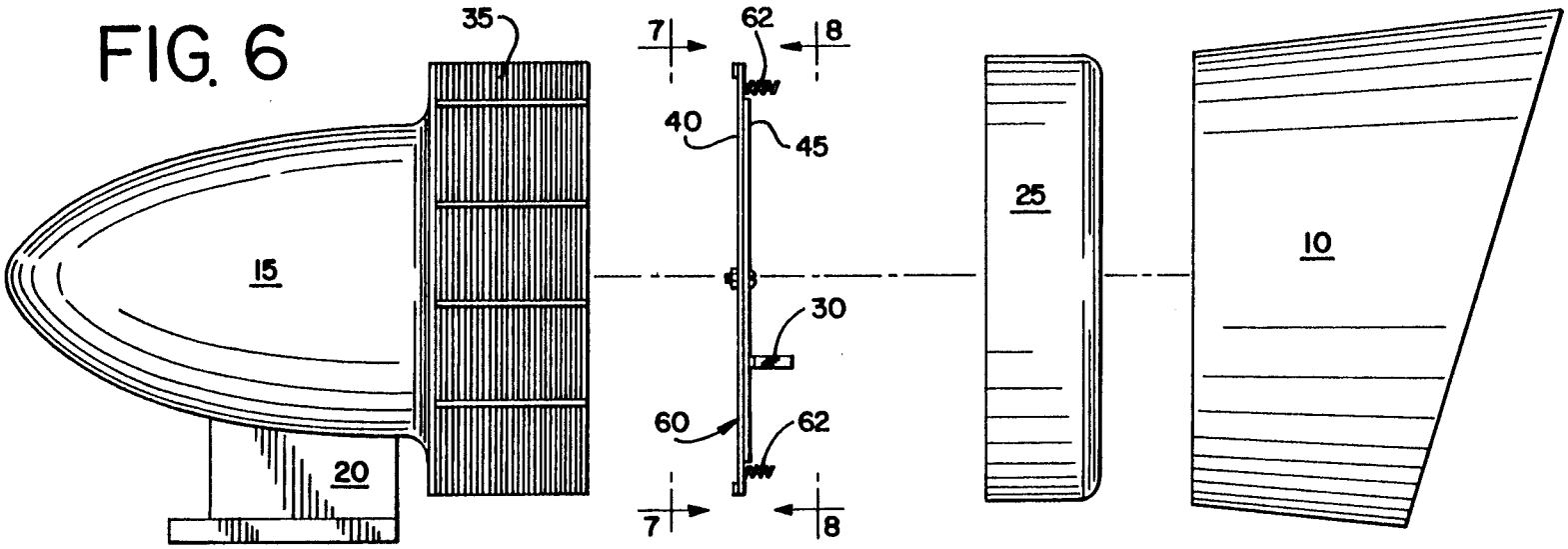
FIG. 6 is an exploded view of the present invention as mounted integral with a siren.

FIG. 6 is an exploded side elevational view with mounting hardware 20 supporting siren 15 and side grill 35. Complementary disks 40 and 45 comprise damper 60. Movable adjusting arm 30 rotates complementary disks 40 and 45 to vary openings 55 (as shown in FIG. 4) Damper mounting hardware 62 supports the disks in place. Front face place 25 and trumpet 10 are also depicted.

Figure 8:
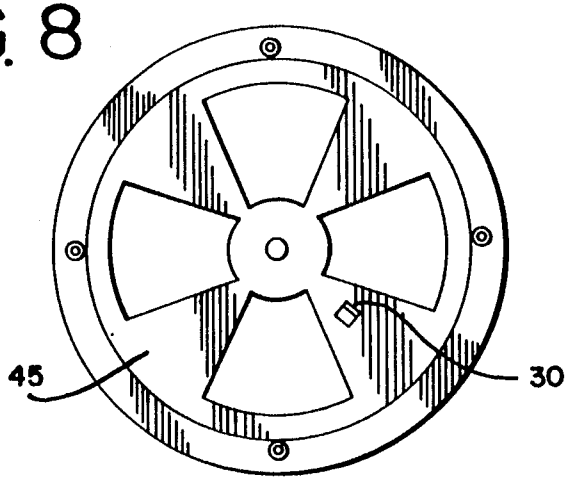
FIG. 8 is a front view of the internal sound baffle.
Figure 7:
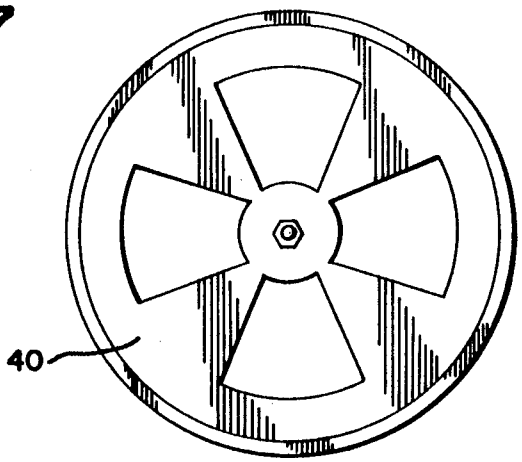
FIG. 7 is a rear view of the internal sound baffle.

Internal sound baffle disk 40 is depicted in FIG. 7 and disk 45 in FIG. 8.

The invention operates by the user moving adjusting arm 30 to rotatably adjust disks 40 and 45 to vary the openings 55 so as to limit the overall amount of air that the siren 15 can intake through front face plate 25 which effectively reduces the overall volume of sound emitted from the siren 15. The air intake amount can be adjusted to suit the desired application of the siren. For example, closing damper 60 can be set for extremely quiet operations such as parades and demonstrations to fully open damper 60 position for maximum volume potential. Adjusting arm 30 allows the present invention installed on a siren 15 to be "tuned" to meet specific sound reduction governmental standards.

The trumpet 10 delivers the chosen sound emitting level in a pre-determined direction which increases the overall air velocity or volume of the siren 15 at moderate to extreme distances.

The present invention is the novel combined operation of the damper or baffle which slows the air velocity into the voice producing mechanism of the siren in conjunction with the conical sound focusing trumpet which thereby increase the air velocity and resulting sound in the desired direction.

The foregoing specification describes only the preferred embodiment of the invention as shown. Other embodiments besides the ones described and shown may be articulated as well. The terms and expressions therefore serve only to describe the invention by example only and not to limit the invention. It is expected that others will perceive differences which while differing from the foregoing, do not depart from the spirit and scope of the invention herein described and claimed.

What is claimed:

1. A sound focusing device for use with a sound emitting device, comprising:

a baffle means for controlling the air supply to said sound emitting device to control the resultant sound from said sound emitting device, said baffle means positioned internal to said sound emitting device, where said baffle means comprises two relatively movable elements containing an aperture; and conical sound focusing means positioned co-axially and external to the sound emitting device.

2. The sound focusing device of claim 1, wherein said conical sound focusing means has a first end and a second end, said first end is at the mouth of said conical sound focusing means such that the resultant emitted sound is increased at said first end of said sound focusing means.

3. The sound focusing device of claim 1, wherein said baffle means selectively slows down the sound emitted from the sound emitting device.

4. The sound focusing device of claim 3 wherein said baffle means comprises at least two disks with defined aperture therein which are selectively adjustable.

5. The sound focusing device of claim 3, wherein said baffle has a plurality of apertures.

6. The sound focusing device of claim 2, wherein said first end of said conical sound focusing means directs sound from the exterior of said sound emitting means.

7. The sound focusing device of claim 1 wherein said sound emitting device is a siren

8. The sound focusing device of claim 1 wherein the conical sound focusing means is a trumpet.

9. A sound focusing device for use with a siren, comprising:

a damper means comprising two relatively movable elements containing an aperture, said damper means having at least one aperture for controlling the volume of air introduced to the siren to control the resultant sound from the siren, said damper positioned internal to the siren; and conical sound focusing trumpet positioned co-axially and external to the siren, said trumpet increasing the velocity of air emanating from the siren.

10. The sound focusing device of claim 9, wherein said trumpet has a first end and a second end, said first end is positioned closer in proximity to the siren than said second end of said trumpet, said velocity of air emanating from the siren is higher at said second end of said trumpet than said first end of said trumpet.

11. The sound focusing device of claim 9, wherein said damper means is comprised of at least two disks forming at least one defined opening therein.

12. The sound focusing device of claim 11 wherein said damper means is selectively adjustable.

13. A sound focusing device for use with a siren having an internal sound producing mechanism, comprising:

a damper means comprising two relatively movable elements containing an aperture, said damper means having at least one aperture for reducing the volume of air introduced to the internal sound producing mechanism to the exterior of the siren, said damper positioned internal to the siren adjacent to the sound producing mechanism; and conical sound focusing trumpet positioned co-axially and external to the siren, said trumpet increasing the velocity of air emanating from the exterior of the siren.

14. The sound focusing device of claim 12 wherein said trumpet has a first end and a second end, said first end is positioned closer in proximity to the siren than said second end of said trumpet, said velocity of air emanating from the siren is higher at said second end of said trumpet than said first end of said trumpet.

15. The sound focusing device of claim 13, wherein said damper means defining at least one adjustable aperture.

16. The sound focusing device of claim 13, wherein said damper means is comprised of at least two complementary disks forming at least one defined opening therein.

17. The sound focusing device of claim 16 wherein said damper means is selectively adjustable.

18. The sound focusing device of claim 13 wherein said damper means is selectively adjustable.

* * * * *